US009079683B2

(12) United States Patent
Viola Terés et al.

(10) Patent No.: US 9,079,683 B2
(45) Date of Patent: Jul. 14, 2015

(54) PALLET BASE AND PALLET PROVIDED WITH SAID BASE

(71) Applicant: Josep Ramon Viola Terès, Tarragona (ES)

(72) Inventors: Josep Ramon Viola Terés, Cambrils (ES); David Ros Cops, Tarragona (ES)

(73) Assignee: Josep Ramon Viola Teres, Cambrils, Tarragona (ES)

( * ) Notice: Subject to any disclaimer, the term of this patent is extended or adjusted under 35 U.S.C. 154(b) by 0 days.

(21) Appl. No.: 14/349,631

(22) PCT Filed: Oct. 11, 2012

(86) PCT No.: PCT/ES2012/070705

§ 371 (c)(1),
(2) Date: Apr. 3, 2014

(87) PCT Pub. No.: WO2013/053970

PCT Pub. Date: Apr. 18, 2013

(65) Prior Publication Data

US 2015/0033991 A1 Feb. 5, 2015

(30) Foreign Application Priority Data

Oct. 14, 2011 (ES) ..... 201131649

(51) Int. Cl.
*B65D 19/38* (2006.01)
*B65D 19/00* (2006.01)
(Continued)

(52) U.S. Cl.
CPC ..... *B65D 19/0097* (2013.01); *B65D 19/0075* (2013.01); *B65D 19/38* (2013.01); *B65D 21/0233* (2013.01); *B65D 19/40* (2013.01); *B65D 2519/008* (2013.01);
(Continued)

(58) Field of Classification Search
USPC ..... 108/51.3, 57.25, 901, 902, 51.11, 55.1, 108/56.3
See application file for complete search history.

(56) References Cited

U.S. PATENT DOCUMENTS 3,199,469 A 8/1965 Sullivan
3,587,479 A * 6/1971 Geschwender ..... 108/51.3
(Continued)

FOREIGN PATENT DOCUMENTS

DE 1960867 A1 6/1971
FR 2350268 A1 12/1977
(Continued)

OTHER PUBLICATIONS

Belda Soriano, Leopoldo, "International Search Report," prepared for PCT/ES2012/070705, as mailed Nov. 20, 2012, 4 pages.

*Primary Examiner* — Jose V Chen
(74) *Attorney, Agent, or Firm* — Barnes & Thornburg LLP

(57) ABSTRACT

A pallet base that comprises an internal honeycomb structure made of plastic, a metal sheet arranged on either side of the internal honeycomb structure that extends over an entirety of the internal honeycomb structure, and an outer sheet of plastic adjoined to each metal sheet. The internal honeycomb structure includes a plurality of honeycomb cells and a plurality of joining edges of the honeycomb cells. The joining edges of the honeycomb cells include ends that extend away from said honeycomb cells. The metal sheets may be provided with through-holes for passage of the ends of said joining edges. The ends of said joining edges may be heat-welded to the outer sheets of plastic.

18 Claims, 8 Drawing Sheets

(51) Int. Cl.
*B65D 21/02* (2006.01)
*B65D 19/40* (2006.01)

(52) U.S. Cl.
CPC ..... *B65D 2519/00024* (2013.01); *B65D 2519/00034* (2013.01); *B65D 2519/00044* (2013.01); *B65D 2519/00059* (2013.01); *B65D 2519/00069* (2013.01); *B65D 2519/0094* (2013.01); *B65D 2519/00273* (2013.01); *B65D 2519/00293* (2013.01); *B65D 2519/00303* (2013.01); *B65D 2519/00323* (2013.01); *B65D 2519/00338* (2013.01); *B65D 2519/00402* (2013.01); *B65D 2519/00437* (2013.01); *B65D 2519/00562* (2013.01); *B65D 2519/00567* (2013.01)

(56) References Cited

U.S. PATENT DOCUMENTS

| | | | | | |
|---|---|---|---|---|---|
| 3,661,099 | A * | 5/1972 | Shelor | ..... | 108/57.34 |
| 3,709,161 | A * | 1/1973 | Kauffman | ..... | 108/57.34 |
| 3,982,057 | A * | 9/1976 | Briggs et al. | ..... | 108/51.3 |
| 4,319,530 | A * | 3/1982 | Moog | ..... | 108/51.3 |
| 5,111,754 | A * | 5/1992 | Adams, Jr. | ..... | 108/51.3 |
| 5,205,221 | A | 4/1993 | Melin et al. | | |
| 5,269,219 | A * | 12/1993 | Juvik-Woods | ..... | 108/51.3 |
| 5,551,353 | A * | 9/1996 | Fiedler | ..... | 108/51.3 |
| 5,566,624 | A | 10/1996 | Brown et al. | | |
| 6,250,234 | B1 * | 6/2001 | Apps | ..... | 108/57.25 |
| 6,651,815 | B1 | 11/2003 | Koefelda | | |
| 6,745,703 | B2 * | 6/2004 | Torrey et al. | ..... | 108/51.11 |
| 8,146,516 | B2 * | 4/2012 | Linares | ..... | 108/57.25 |
| 2002/0002937 | A1 * | 1/2002 | Modesitt et al. | ..... | 108/51.3 |
| 2003/0079657 | A1 * | 5/2003 | Preisler | ..... | 108/51.3 |
| 2006/0081159 | A1 * | 4/2006 | Chapman et al. | ..... | 108/57.25 |
| 2006/0130712 | A1 * | 6/2006 | Wang | ..... | 108/57.25 |
| 2008/0196633 | A1 * | 8/2008 | Ho | ..... | 108/51.3 |
| 2009/0025616 | A1 | 1/2009 | Merrill et al. | | |
| 2009/0116925 | A1 | 5/2009 | Juchniewicz et al. | | |
| 2010/0043678 | A1 * | 2/2010 | Linares | ..... | 108/57.25 |

FOREIGN PATENT DOCUMENTS

| | | | |
|---|---|---|---|
| GB | 2089316 | A | 6/1982 |
| WO | WO-2006011728 | A1 | 2/2006 |

* cited by examiner

PALLET BASE AND PALLET PROVIDED WITH SAID BASE

The present invention relates to a base for a pallet and a pallet provided with the latter, made of plastic with metal parts, stackable and highly resistant to bending, and which allows safe handling on pallet shelving.

BACKGROUND OF THE INVENTION

The state of the art is familiar with bases for pallets which comprise an internal honeycomb structure made of plastic, two metal sheets arranged on either side of the plastic internal structure and two outer sheets made of plastic adjoined to the metal sheets.

Patent document WO2006/011728 describes an example of this type of base for pallets. However, the object of said patent presents a series of drawbacks which limit its usefulness, which explains their low level of introduction on a wide scale.

In the first place, it has a very complex structure, with many parts, especially complex laminates, which imply costly processes and not very competitive costs.

The complex laminates stem from the need to supply adjoining surfaces to carry out the close binding between the different layers.

This close binding is necessary to guarantee that the metal sheets fulfil their function of resisting tangential stresses occurring when loads are supported on the pallet.

Also, said close binding is weak against fatigue, very especially against relative displacements of the layers, caused by dilations or use.

At the same time, the state of the art is not familiar with pallets made of plastic, which are nestable and capable of withstanding loads of at least one tonne when arranged on shelving provided with support beams.

Other examples of such structures are constituted by patent documents U.S. 2009116925 A1, U.S. Pat. No. 6,651,815 B1. Patent documents U.S. Pat. No. 5,205,221 A, GB 2089316 A, U.S. Pat. No. 5,566,624 A and U.S. 2009025616 A1 describe pallets related to the invention.

For these reasons, the inventors of the present invention consider it necessary to develop a pallet base, in addition to a pallet provided with said base to solve the drawbacks of the state of the art.

DESCRIPTION OF THE INVENTION

To do this, a pallet base is proposed which comprises:

an internal honeycomb structure made of plastic;

two metal sheets arranged on either side of the plastic internal structure and which extend over the entire internal honeycomb structure;

two outer sheets of plastic adjoined to the metal sheets;

and characterised in that the ends of all the joining edges of the honeycomb cells overhang said cells, the metal sheets being provided with through-holes for passage of the ends of said edges, said ends being heat-welded to the outer sheets of plastic.

This structure allows a superficially homogeneous joining between the metal sheets and the rest of the base and is capable of withstanding great tangential efforts. Especially, it has been possible to verify that it is capable of supporting, even on shelving, loads of more than one tonne.

Also, it simplifies the structures of the state of the art, and it can be manufactured at a lower cost.

None of the documents cited in the background discloses these characteristics. Nor is it obvious to combine the described documents to reach the claimed invention.

U.S. 2009116925 describes a base which comprises an internal honeycomb structure made of plastic, two metal sheets arranged on either side of the plastic internal structure and two outer sheets made of plastic adjoined to the metal sheets.

However, nowhere does it suggest that the ends of the joining edges of the honeycomb cells overhang said cells, the metal sheets being provided with through-holes for passage of the ends of said edges, said ends being heat-welded to the outer sheets of plastic.

U.S. Pat. No. 6,651,815 B1 also describes two metal sheets arranged on either side of the plastic internal structure and two outer frames made of plastic adjoined to the metal sheets.

Similarly, it describes the ends of joining edges of some cells, which are rectangular and not honeycombed, which overhand said cells, the metal frames being provided with through-holes for passage of the ends of said edges.

However, the following differences are present:

- the ends are not heat-welded to the outer sheets made of plastic;
- it is a frame and not a sheet;
- a honeycomb structure is not described, which is why the aforementioned frame is resorted to;

It is precisely the combination of these characteristics that allows much more load to be supported than the bases in the state of the art.

In particular, the close binding through heat-welding between the outer sheets and the internal structure is essential, and it is also essential for the metal sheets to cover the entire honeycomb structure.

On a separate note, according to various optional characteristics of the invention:

- the internal honeycomb structure made of plastic has a lateral border hat closes the perimeter cells, said lateral border extending along both sides to configure respective frames for nesting and joining the outer plastic sheets adjoined to the metal sheets.
- the lateral border extends on the upper face over a greater distance than the added thickness of the metal sheets and outer plastic sheets, in such a way as to constitute a lateral retaining rim of the loads that are on the pallet.
- the base comprises openings through it for the fitting of legs.
- the openings comprise reinforcing walls joined to the honeycomb cells.
- these openings present a change in section in such a way that a support surface is configured for the legs and preferably, they have, seen in the direction of opening, an elliptical contour with two circular inlets on the nearest sides of the ellipse.
- according to an especially preferred variant, the base comprises nine substantially elliptical openings, four on the corners and directed in the direction of the maximum dimension of the base, three in the middle part aimed in the direction of maximum dimension of the base, the other two being oriented perpendicularly to the rest.
- the walls of the openings are inclined to allow for nested stacking of several pallets.
- the base comprises in its internal structure two reinforcing beams centres and crossed and closely joined to the honeycomb structure.
- the base comprises two inclined rabbets on one of its shorter sides for nesting the prongs of a fork.

On a separate note, the invention also relates to a pallet comprising a base such as the one described and removable legs.

Preferably, its legs comprise a metal insert in their base, level or overhanging in respect to the body of the leg and which extends over practically the entire length of the leg.

Advantageously, the legs comprise vertical ribs for support and fixing of the insert and support of a stacked pallet.

More preferably, the legs comprise drainage holes in the base of the legs.

Preferably, the pallet comprises fixing means through clipping the legs to the base.

Finally, in the pallet of the invention, the leg inserts have a section consisting of a support portion rounded on its support zone, and a straight line portion for rigidity in the longitudinal direction of the leg.

The invention also relates to a leg for a pallet, formed by a moulded plastic body, preferably with an oblong section, characterised in the fact that it comprises a metal insert in its base oriented in the largest dimension, said metal insert being level or overhanging in respect to the body of the leg and which extends over practically the entire base of the leg.

Preferably, the leg comprises internal ribs moulded together with the walls of the leg, the insert being interwoven in one of said ribs, in such a way that loads can be transmitted from the insert to the body of the leg.

Advantageously, the leg comprises one or more metal inserts, parallel to each other or not.

More preferably, the insert or inserts have a section consisting of a support portion rounded on its support zone, and a straight line portion for rigidity.

Finally, the leg comprises outer vertical ribs for rigidity.

BRIEF DESCRIPTION OF THE DRAWINGS

For a better understanding of the description, a set of drawings is attached, where, schematically and by way only of a non-limiting example, a practical case of embodiment is represented.

DESCRIPTION OF A PREFERRED EMBODIMENT

Figure 1:
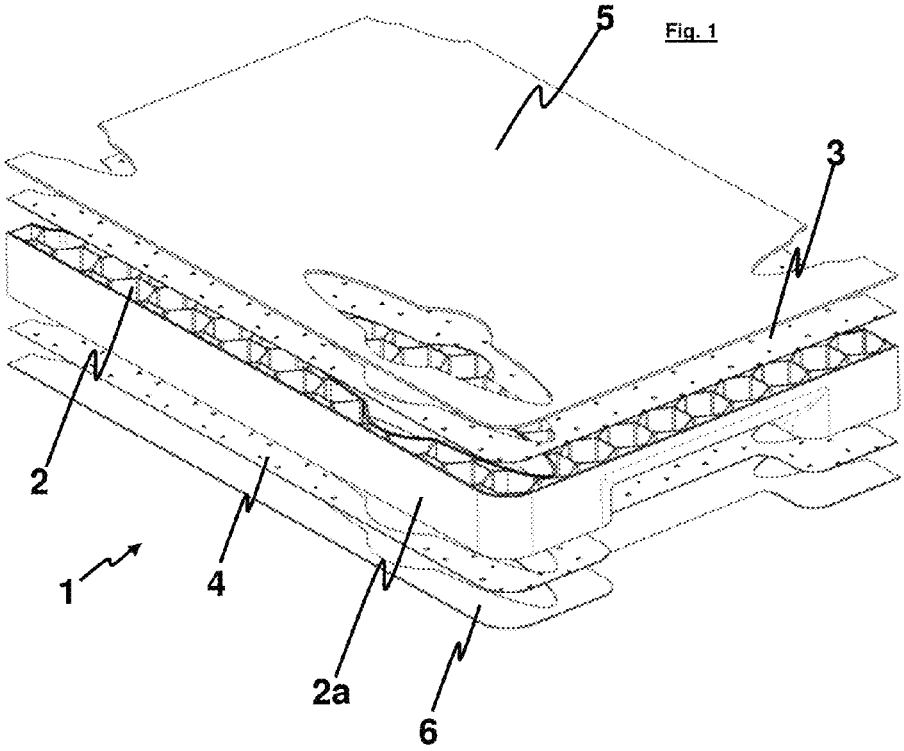
FIG. 1 is an exploded view in perspective of a quarter of a pallet base according to the invention wherein it is possible to appreciate its different basic layers.
Figure 2:
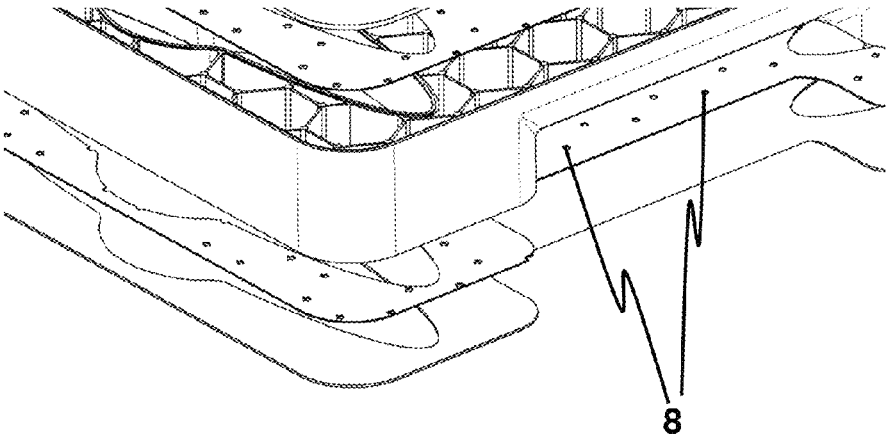
FIG. 2 shows an enlarged view of a sector of FIG. 1.

As can be appreciated from FIG. 1, the invention relates in a general manner to a base 1 for a pallet P which comprises a plastic internal honeycomb structure 2, two metal sheets 3, 4 arranged on either side of the plastic internal structure 2, which extend over the entire internal honeycomb structure, and two outer sheets of plastic 5, 6 adjoined to the metal sheets 3, 4.

Specifically, according to the invention, the ends of the joining edges 7 of the honeycomb cells overhang said cells, the metal sheets 3, 4 being provided with through-holes 8 for passage of the ends of said edges 7 in such a way that it is possible to closely bind said ends to the outer sheets of plastic 5, 6. This binding can be achieved through heat-welding, with it being essential for there to be continuity between the material of said ends and the outer sheets of plastic.

The metal sheets comprise holes in all points corresponding to the honeycomb edges.

This structure allows, among others, to keep mechanically stable the pallet loaded on shelving during long periods of time without significant deformations due to viscoelastic creep, which is one of the objectives of the invention.

The plastic internal honeycomb structure 2 has a lateral border 2*a* that closes the perimeter cells, said lateral 2*a* border extending on either side to configure respective frames for nesting and joining the outer plastic sheets adjoined to the metal sheets.

All joints are made by heat-welding, in such a way that the cover sheets of plastic are homogeneously and closely bound to the internal honeycomb structure, achieving the fixing to each other of the metal sheets, which will be responsible for withstanding bending of the pallet when it is subjected to high loads.

This lateral border is obtained from one piece together with the honeycomb, which further guarantees the monolithic level of base of the pallet.

Figure 5:
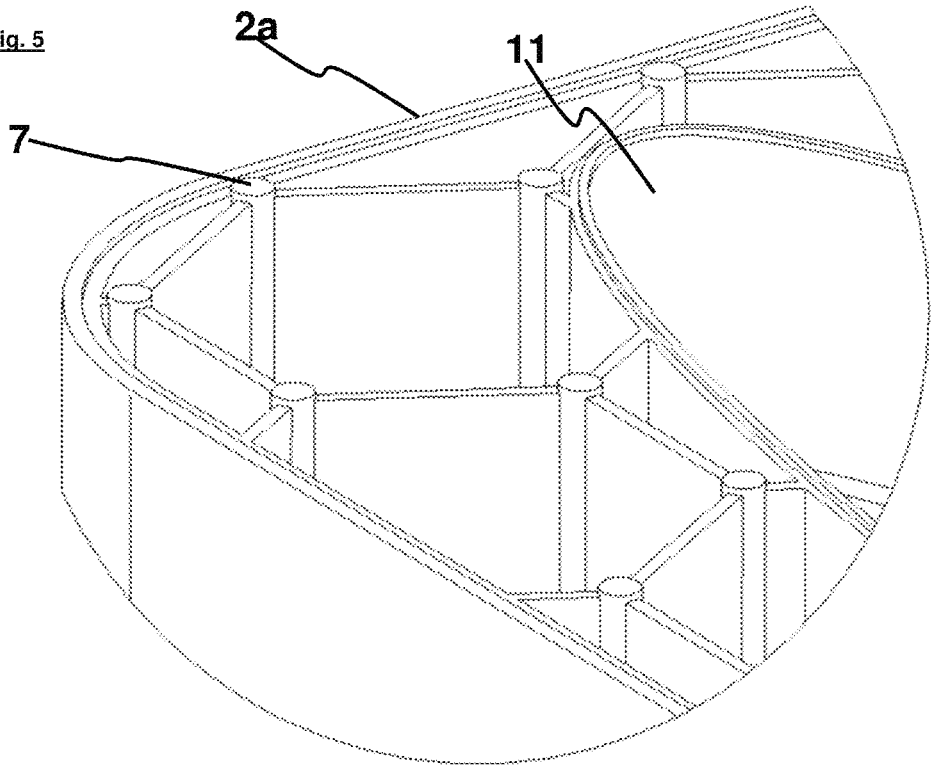
FIG. 5 is a perspective in close-up corresponding to one of the openings designed for the legs wherein it is possible to appreciate the reinforcing wall.

Said lateral border 2*a*, FIG. 5, extends over a greater distance than the added thickness of the metal sheets and outer plastic sheets, in such a way as to constitute a lateral retaining rim of the loads that are on the pallet.

Figure 3:
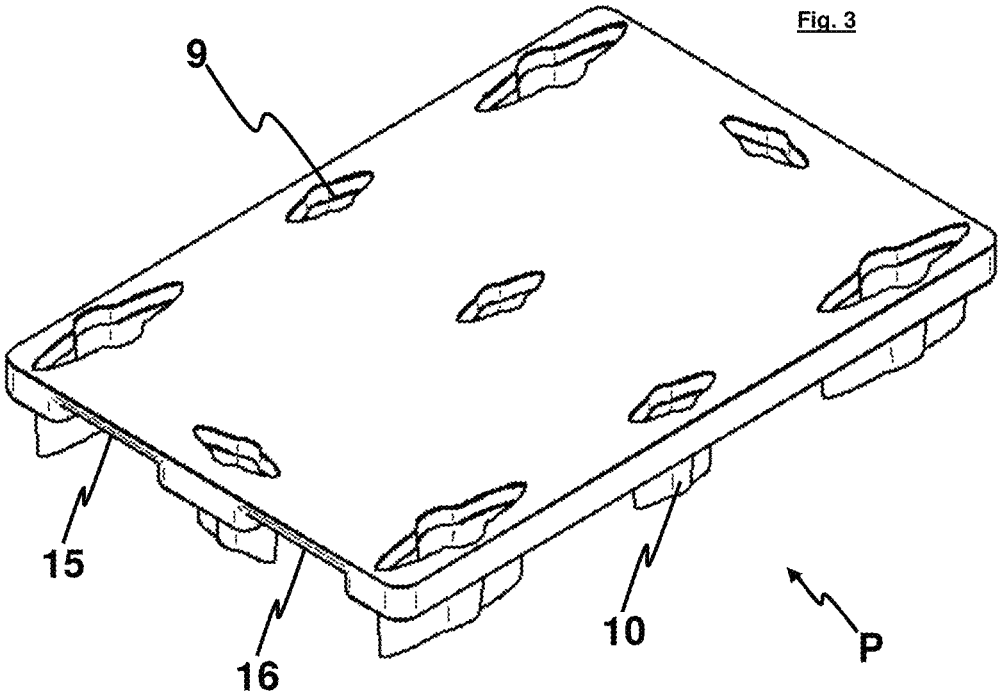
FIG. 3 is a perspective of a pallet according to the invention, mounted and with the legs assembled.
Figure 4:
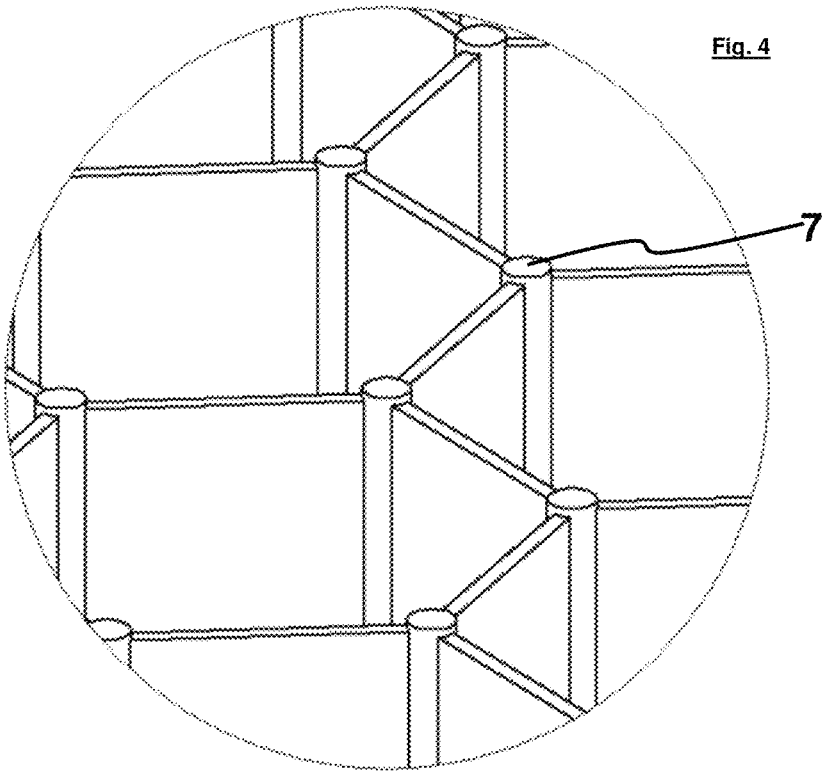
FIG. 4 is a perspective in close-up showing how the edges of the honeycomb overhang, whose overhanging edges will serve to fix the cover sheets.

For nesting of the legs, openings 9 are contemplated, FIG. 3.

These openings comprise reinforcing walls 11 joined to the honeycomb cells, in such a way that even though they interrupt it, they present sufficient thickness to guarantee the resistance of the base.

Figure 6:
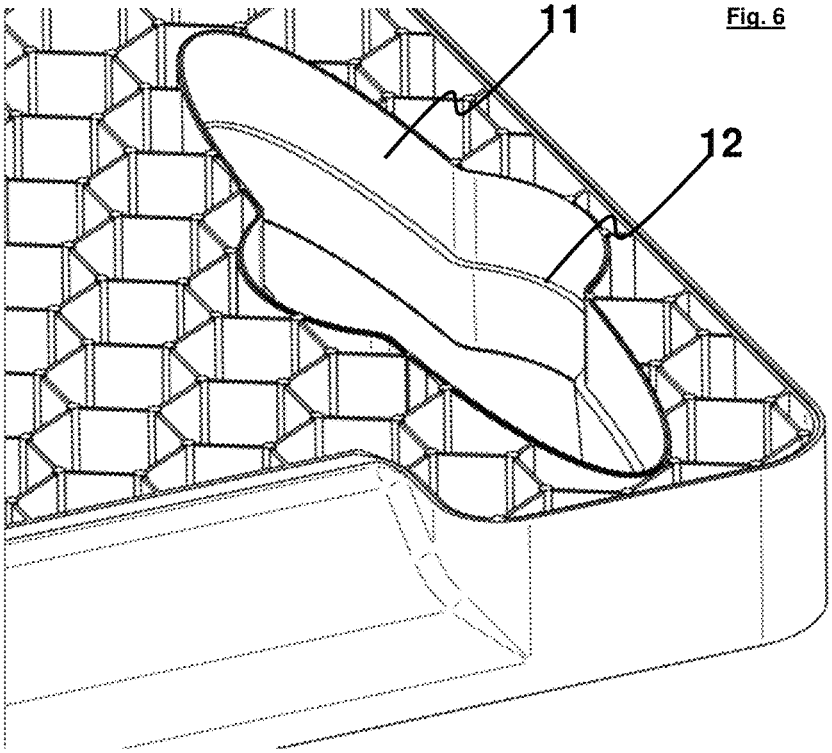
FIG. 6 is a view of an inverted base, in such a way that it is possible to appreciate the change in section of the opening that constitutes a support surface for the legs.
Figure 7:
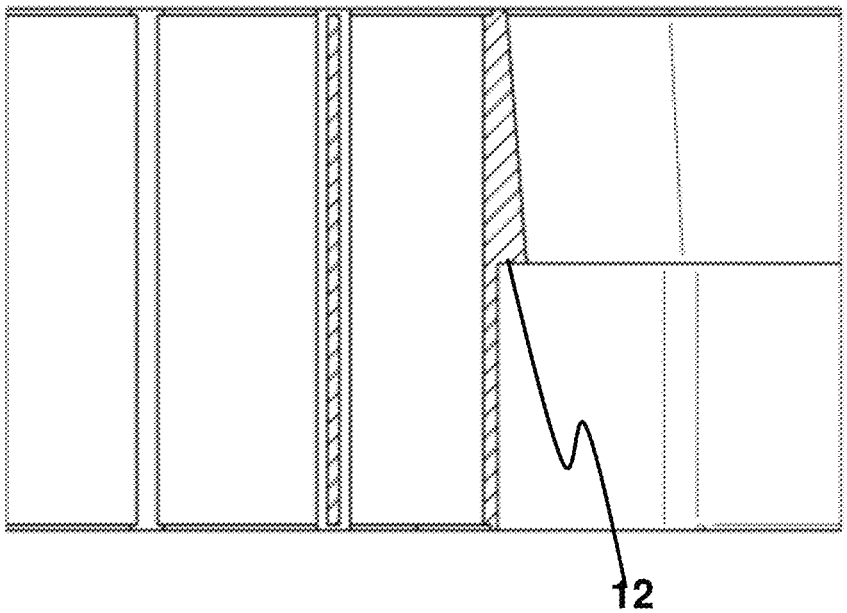
FIG. 7 is a cross-section along a plane that passes through one of the openings, which makes it possible to see the changes in section of the opening.

As can be appreciated from the cross-section of FIG. 7, and the perspective of FIG. 6, the openings 9 present a change in section in such a way as to configure a continuous support surface 12 for the legs 10.

The openings 9 and the corresponding legs have, seen in the direction of opening, an elliptical contour with two circular inlets on the nearest sides of the ellipse. This shape prevents high points of stress, and the turning of the leg in the opening following a horizontal transversal axis.

Figure 9:
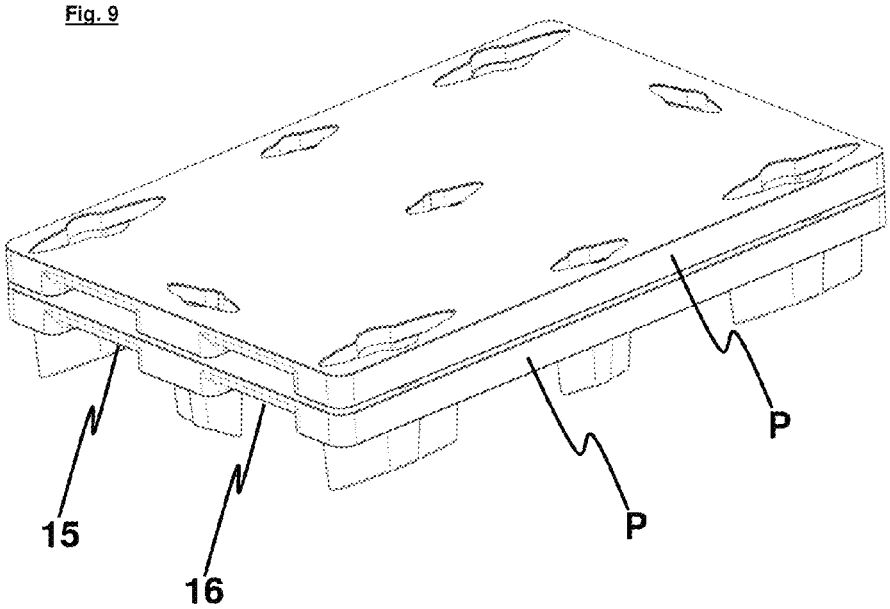
FIG. 9 is a perspective showing the stacking of two pallets.
Figure 10:
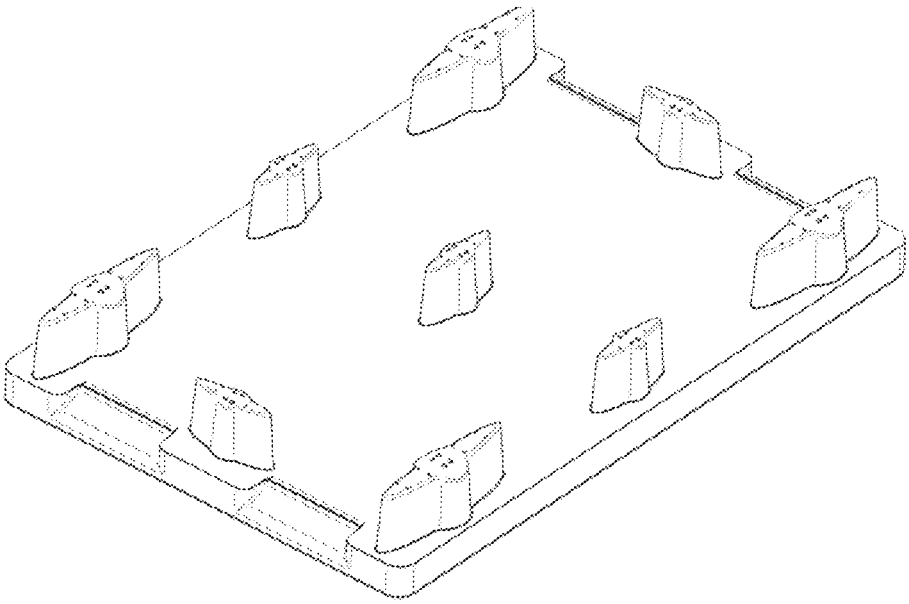
FIG. 10 shows an overturned pallet with the legs assembled.

As can be appreciated in FIGS. 3 and 9, according to an especially preferred variant, the base comprises nine substantially elliptical openings, four on the corners and directed in the direction of the maximum dimension of the base, three in the middle part aimed in the direction of the maximum dimension of the base, the other two being oriented perpendicularly to the rest.

The difference in length of the legs allows the pallet to be adapted to the systems of transport.

Specifically, the longitudinal legs, which are longer, allow the pallet to travel on logistics trains of rollers and chains. The perpendicular ones, make it compatible with the guide systems of roller trains.

As can be appreciated from the cross-section of FIG. 7, the walls of the openings are inclined to allow for nested stacking of several pallets.

Figure 8:
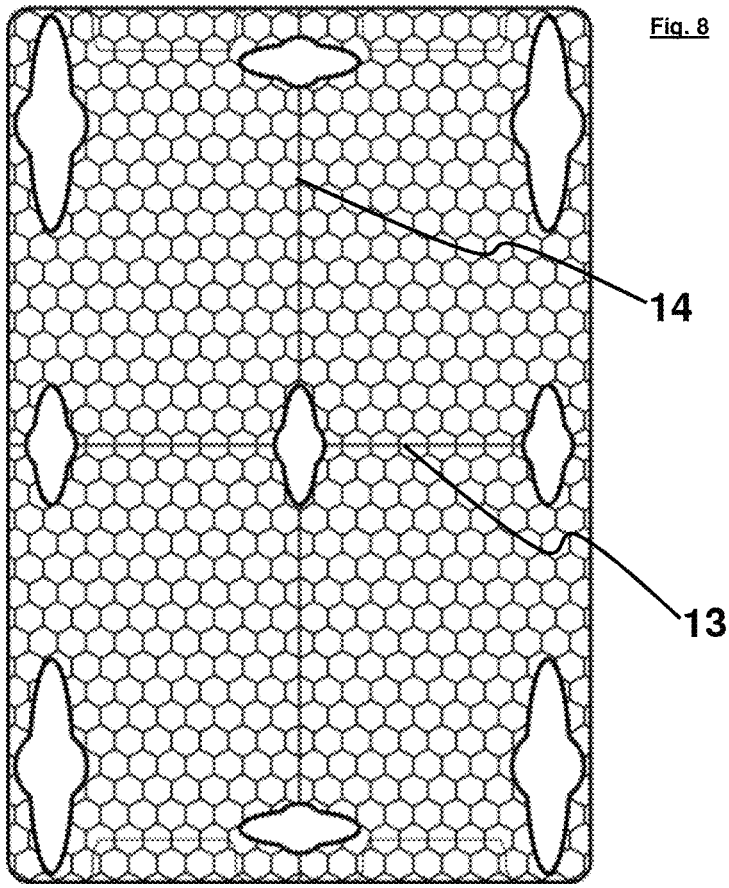
FIG. 8 is a plan view across a horizontal section of the pallet, in such a way that it is possible to appreciate the honeycomb and also the crossed reinforcements or beams that divide the pallet into four sectors.

As can be appreciated from FIG. 8, two reinforcing beams 13, 14 are contemplated in the internal structure, centred and crossed and closely joined to the honeycomb structure. These beams increase the rigidity of the base 1.

As can be appreciated from FIG. 9, the base comprises two inclined rabbets 15, 16 on both of its shorter sides for nesting the prongs of a fork.

The invention also relates to a pallet provided with a base such as the one described and removable legs 10.

These legs comprise a metal insert 17 in their base, level or overhanging in respect to the body of the leg and which runs along practically the entire length of the leg. In this way, the pallet can be occasionally supported on these inserts, allowing it to rest on shelving of the type that comprises two beams. This characteristic is critical. Without these inserts, with the pallet loaded and arranged on shelving on beams for a time, the legs on occasional support would deform due to the plastic's viscoelastic behaviour. The result is the pallet's instability and consequently its incapacity to continue supporting the load on shelving. The inserts distribute the loads, and avoid these deformations, which allow storage at height for a long duration even with high loads.

Figure 11:
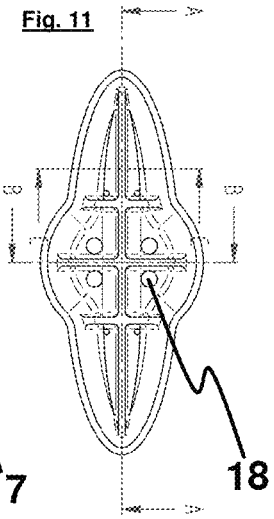
FIG. 11 is a cross-section of a leg, wherein it is possible to appreciate the shape of its contour and also the shape of the ribs for rigidity and support of the metal insert.
Figure 14:
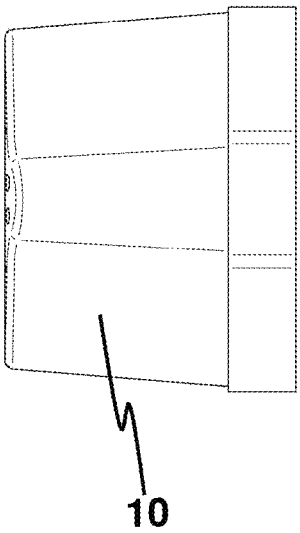
FIG. 14 is an elevation of the leg.
Figure 15:
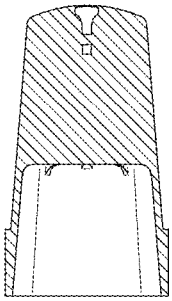
FIG. 15 is another cross-section on another plane of the leg.

As can be appreciated from the cross-section of FIG. 11, to guarantee the transmission of forces within the legs, ribs are contemplated.

These ribs guarantee the fixing of the insert and the distribution of loads by the leg.

Also, its height inside the leg is determined so that a pallet stacked on top of the pallet in question is supported precisely on the surface determined by the upper surface of the rib. In this way, seizing is avoided and a space is provided between successive pallet for introducing the prongs of a fork.

To guarantee the drainage of water and avoid its accumulation, the legs comprise drainage holes 18 in their base, as illustrated in FIG. 11.

The leg inserts have a section consisting of a support portion rounded in its support zone, and a straight line portion for rigidity. To guarantee a centred support and even in cases of deformation through bending, it is contemplated for the support surface of the insert to be rounded in both directions.

Figure 20:
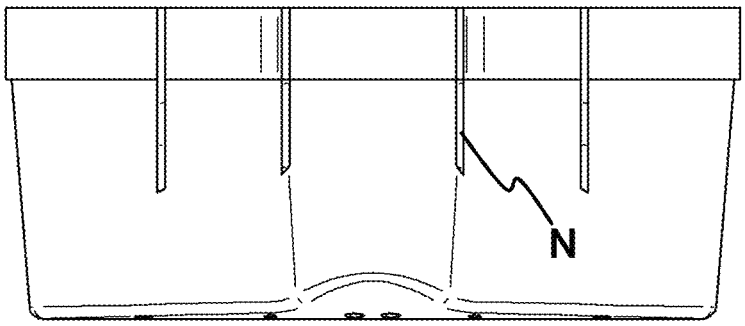
FIGS. 20 and 21 show two elevations of the legs wherein these are provided with outer vertical rigidity ribs.
Figure 21:
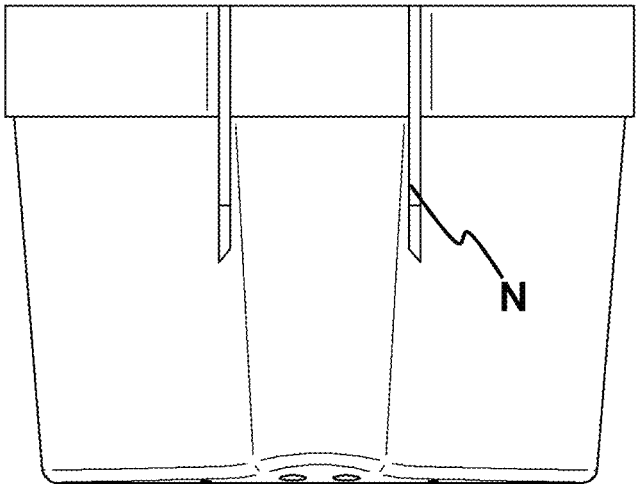

FIGS. 20 and 21 show preferred embodiments of the legs, wherein they are provided with outer vertical rigidity ribs N.

Figure 16:
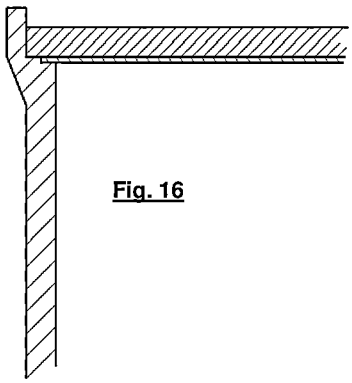
FIGS. 16 to 19 show four different design options of the perimeter joint.
Figure 17:
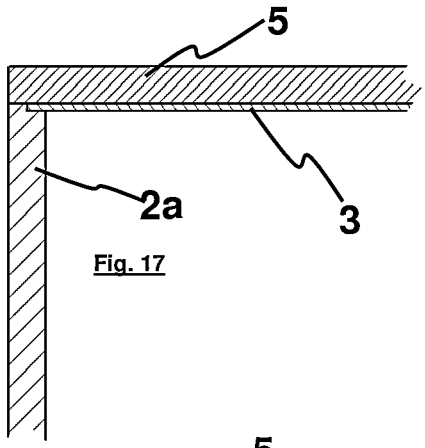

In respect of the join between the two outer plastic sheets 5, 6 with the perimeter border of the base, as appreciated from FIGS. 16 to 17 it can be carried out in two ways.

The join with the plastic covers can be with a perimeter border, as shown in FIG. 16, or aligned with it, as in FIG. 17.

When the join is with a perimeter lip, it is preferred for it to overhang slightly from the vertical projection of the pallet, for which an inclined portion is contemplated.

Figure 18:
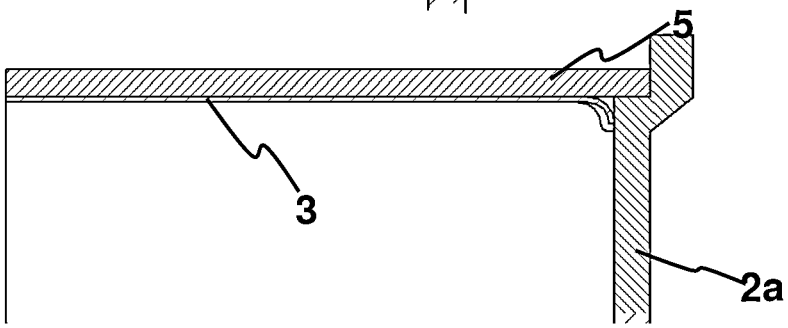
Figure 19:
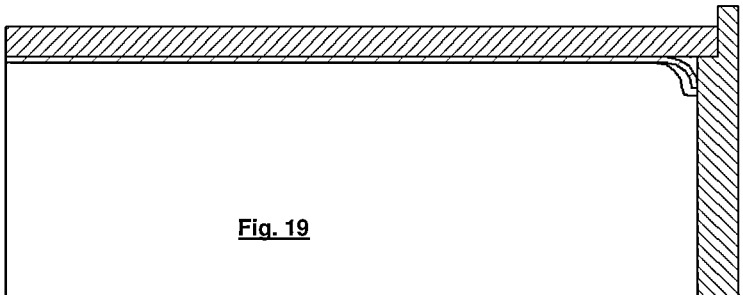

FIGS. 18 and 19 show another join alternative, wherein the cornering of the sheets is circular, and the ledge is housed between the honeycomb and the outer wall. In both cases, a perimeter border is contemplated, although with two different options, one with an incline, and the other totally horizontal.

The join with the vertically overhanging perimeter border is only made in the upper part.

The invention also relates to a leg 10 for a pallet P, formed by a moulded plastic body, preferably with an oblong section, which comprises a metal insert 17 in its base oriented in the largest dimension, said metal insert 17 being level or overhanging in respect to the body of the leg 10 and which extends over practically the entire base of the leg 10.

The leg is obtained through moulding, has a preferably oblong and hollow section, without considering the internal ribs and the insert.

As can be appreciated from the cross-section of FIG. 11, the leg comprises internal ribs moulded together with the walls of the leg, each insert being interwoven in a rib, in such a way that loads can be uniformly transmitted to the rest of the ribs and from these to the body of the leg. These internal ribs are vertical flat beams which join the outer wall of the leg, for example one in a longitudinal sense and the other in transversal sense.

In some cases, it may be necessary to contemplate wider legs, in which case two or more metal inserts 10 will be contemplated, in parallel or not.

Figure 13:
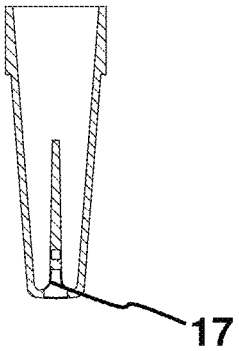
FIG. 13 is a vertical cross-section of the leg, wherein it is possible to appreciate the section of the insert.
Figure 12:
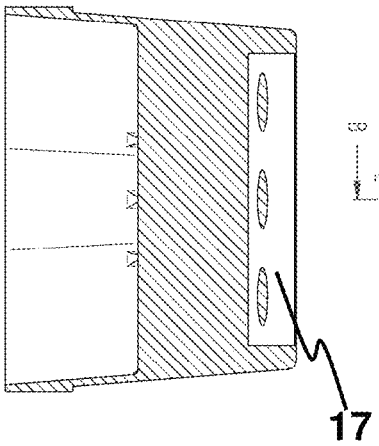
FIG. 12 is a corresponding cross-section in elevation.

As can be appreciated from FIG. 13, the insert or inserts have a section consisting of a support portion rounded in its support zone, and a straight line portion for rigidity.

In this way, although the leg pivots slightly, effective support is guaranteed by means of said rounded surface.

Finally, as can be appreciated from FIGS. 20 and 21, the leg comprises outer vertical ribs N for rigidity.

The invention claimed is:

1. A pallet base which comprises:

an internal honeycomb structure made of plastic, the internal honeycomb structure including a plurality of honeycomb cells and a plurality of joining edges of the honeycomb cells;

a metal sheet arranged on either side of the internal honeycomb structure, each metal sheet extending over an entirety of the internal honeycomb structure;

an outer sheet of plastic adjoined to each of the two metal sheets;

wherein the joining edges of the honeycomb cells include ends that extend away from said honeycomb cells, the metal sheets being provided with through-holes for passage of the ends of said joining edges, said ends of said joining edges being heat-welded to the outer sheets of plastic.

2. The pallet base according to claim 1, wherein the plurality of honeycomb cells includes perimeter cells, and the pallet base has a lateral border that closes the perimeter cells, said lateral border extending on either side of the internal honeycomb structure.

3. The pallet base according to claim 2, wherein the metal sheets and outer plastic sheets define an added thickness, and said lateral border extends over a greater distance than the added thickness of the metal sheets and outer plastic sheets, to define a lateral retaining rim of the loads that are on the pallet.

4. The pallet base according to claim 1, which comprises openings sized for nesting of legs.

5. The pallet base according to claim 4, wherein said openings are defined by reinforcing walls joined to the honeycomb cells.

6. The pallet base according to claim 5, wherein the walls of the openings are inclined to allow for nested stacking of several pallets.

7. A pallet comprising a pallet base according to claim 5 and further comprising removable legs configured to be attached to the pallet base.

8. The pallet according to claim 7, wherein each of the legs comprises a metal insert.

9. The pallet according to claim 8, comprising a vertical rib to secure each insert and support of a stacked pallet.

10. The pallet according to claim 8, wherein each of the leg inserts has a section consisting of a support portion rounded in its support zone, and a straight line portion for rigidity.

11. The pallet according to claim 7, wherein each leg includes a base and drainage holes are defined in the base of each leg the leg.

12. The pallet according to claim 7, comprising means for fixing the legs to the base.

13. The pallet according to claim 7, wherein the legs comprise outer vertical ribs.

14. The pallet base according to claim 4, wherein said openings have, seen in the direction of opening, an elliptical contour including a pair of nearest sides and two circular inlets on the nearest sides of the contour.

15. The pallet base according to claim 4, which comprises nine substantially elliptical openings, wherein the base includes a number of corners, and four of the substantially elliptical openings are positioned on the corners and directed in the direction of a maximum dimension of the base, three of the substantially elliptical openings are positioned in a middle part of the base aimed in the direction of the maximum dimension of the base, the other two of the substantially elliptical openings are aimed perpendicularly to the rest of the substantially elliptical openings.

16. A pallet comprising a pallet base according to claim 4.

17. The pallet base according to claim 1, which comprises in its internal structure two reinforcing beams centered and crossed and closely joined to the honeycomb structure.

18. The pallet base according to claim 1, which comprises a number of shorter sides and two inclined rabbets on one of its shorter sides for nesting the prongs of a fork.

* * * * *